US005441472A

United States Patent [19]

Johnston

[11] Patent Number: 5,441,472

[45] Date of Patent: Aug. 15, 1995

[54] PIVOTING THIGH ENGAGING EXERCISE APPARATUS HAVING FRICTIONAL RESISTANCE

[76] Inventor: Gary L. Johnston, P.O. Box 183, Cowarts, Ala. 36321

[21] Appl. No.: 234,544

[22] Filed: Apr. 28, 1994

[51] Int. Cl.[6] ..... A63B 21/015

[52] U.S. Cl. ..... 482/118; 482/120; 482/138; 482/142; 601/34

[58] Field of Search ..... 482/142, 133, 134, 135, 482/136, 137, 138, 118, 119, 120; 601/33, 34, 35

[56] References Cited

U.S. PATENT DOCUMENTS

| | | | |
|---|---|---|---|
| 2,548,408 | 4/1951 | Tammen | 482/142 |
| 4,240,627 | 12/1980 | Brentham | 482/138 |
| 4,834,072 | 5/1989 | Goodman | 482/142 |
| 4,930,497 | 6/1990 | Saringer | 601/34 |
| 5,035,234 | 7/1991 | Forsythe | 482/142 |
| 5,158,513 | 10/1992 | Reeves | 402/142 |

*Primary Examiner*—Lynne A. Reichard

[57] ABSTRACT

A pivoting exercise apparatus comprising a structural frame, a thigh engagement member, and optional resistance device and motor, whereby the user may engage the thigh engagement member with the thigh portion of their legs and perform lower body exercise routines while in a relatively reclined position. The thigh engagement member is pivotally coupled to the structural frame to pivot in the forward, backward, and side directions. The user may manually produce motion in the thigh engagement member. A resistance may be included to provide a resistance force against this pivoting motion. A motor may also be used to provide automatic pivoting motion of the thigh engagement member.

17 Claims, 10 Drawing Sheets

PIVOTING THIGH ENGAGING EXERCISE APPARATUS HAVING FRICTIONAL RESISTANCE

BACKGROUND OF THE INVENTION

1. Field of the Invention

The present invention relates to a pivoting exercise device. More particular, the present invention relates to an exercise device in which the user, while in a relatively reclined position on the device, engages the device with the general thigh portion of the leg. The user may manually push, pull, and/or twist against the thigh engaged part of the device, whereby exercising routines may be developed which workout mainly the hip, stomach, buttocks, lower back, and thigh areas. A resistance means may be included to provide a resistance force against the motion of the user. The device may utilize an automatic feature for inducing a push, pull, and/or twist motion upon the user.

2. Description of the Prior Art

Currently there exist many exercise devices for exercising the lower body muscle groups, specifically the stomach, hip, buttocks, lower back, and thigh areas. However, most are only suitable for mainly a specific muscle group or possibly a combination of two. Some have proven uncomfortable to operate. For a good many people, especially women, the muscle groups which needs the most exercise are in the aforementioned areas. This device uniquely addresses this problem.

There exist devices upon which the user may sit or stand and performs a twisting exercise routine. This twist motion exercises mainly the stomach and lower back areas. Other devices exist in which the user stands on one leg and engages a pad member with the thigh of the other leg, pushing against a resistance force with the engaged thigh. This works mainly the thigh and buttocks areas, but only one side of the body at a time is exercised. Some exercise devices allow the user to engage pad members with the inner portion and/or outer portion of the thighs, performing a type of exercise routine in which the user feels resistance as they pull their legs together or push their legs apart. This exercise routine works mainly the thigh and hip muscles, and for some people, is not very comfortable. Other exercise devices allow the user to engage a pad member with the thighs while in a reclined position, but the user may push only against the member, no pulling or twisting is possible.

Given that there are a vast number of exercise products for the lower body being sold today, it has come as a surprise that no one has effectively designed a device that can exercise all of the main lower body muscle groups at once, or a selected combination, all from the same exercise device. This device provides this capability, in either a manual or automatic mode of operation. Both thighs of the user are used to operate this device, not one at a time. This therefore cuts down on the required total exercise time. The user operates the device while in a reclined position, which should prove very comfortable for a lot of people, especially those older or disabled. This device is unique in that it provides for selectable twisting, pulling, and/or pushing motion in the lower body area.

SUMMARY AND OBJECTS OF THE INVENTION

The object of the present invention is to provide an exercise device in which the muscles of the lower body area, specifically the stomach, hip, buttocks, lower back, and thigh areas, can be exercised simultaneously, or in some combination, as selected by the user. One version may allow for manual operation of the device with exercising motions in the described lower body muscles being induced by the user. A resistance means may be included so that the user feels a resistance force as the exercise routines are performed. A second version of the device may allow for automatic operation of the device, with exercising motion in the lower body area being induced by a motor means. These features allow for a better, more comprehensive, and more versatile workouts than found on similar exercise devices.

Briefly stated, the apparatus that forms the basis of the present invention comprises basically a structural frame means, a thigh engagement means, and optionally a resistance means and motor means. The user positions themselves in a reclined position and engages the thigh engagement means with both thighs. The thighs may be supported at the back, front, and side positions. The thigh engagement means is pivotally coupled to the structural frame means to pivot in a side to side motion, and to pivot in a front to back motion, either together or separately, whichever is desired by the user. The optional resistance means may be used to provide a resistance force against the user as they use their thighs to pivot the thigh engagement means. An optional motor means may be used to create this pivoting motion in the thigh engagement means, thereby inducing motion in the user.

Also, a conventional exercise computer may be part of the apparatus. It will not be shown in the accompanying figures, but may connect to the thigh engagement means and/or the structural frame means to keep track of exercise related data such as number of pivots, elapsed time, calories, etc.

Other objects, features, and advantages for this invention will be apparent from the following detailed description and the appended claims, references being made to the accompanying drawings forming a part of the specification, wherein like reference numerals designate parts of several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1A:
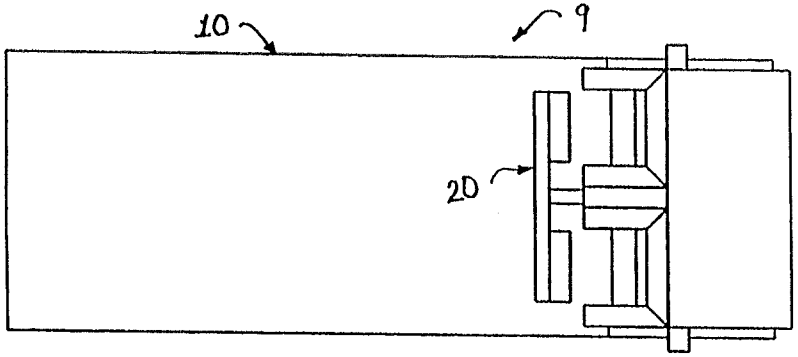
FIG. 1A is a top view of the pivoting exercise apparatus.
Figure 1B:
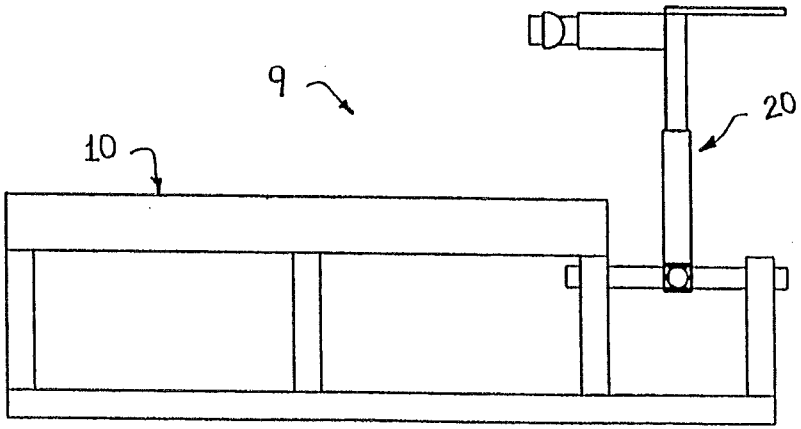
FIG. 1B is a side view of the pivoting exercise apparatus.
Figure 1C:
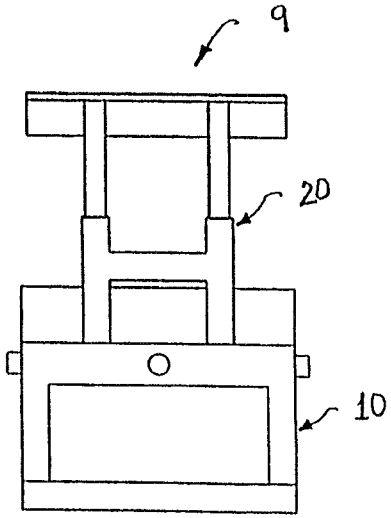
FIG. 1C is a front view of the pivoting exercise apparatus.

As best can be seen by references to the drawings, and in particular to FIGS. 1A, 1B, and 1C, the pivoting exercise apparatus that forms the basis of this invention is designated generally by the reference numeral 9. Pivoting exercise apparatus 9 comprises basically a structural frame means 10 and a thigh engagement means 20. Other features, such as a resistance means or a motor means, may be included in the apparatus for greater versatility.

Figure 2A:
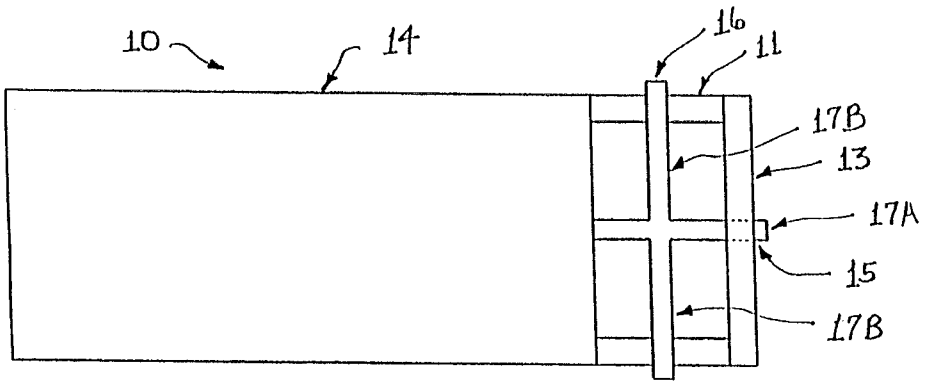
FIG. 2A is a top view of the structural frame means of the pivoting exercise apparatus.
Figure 2B:
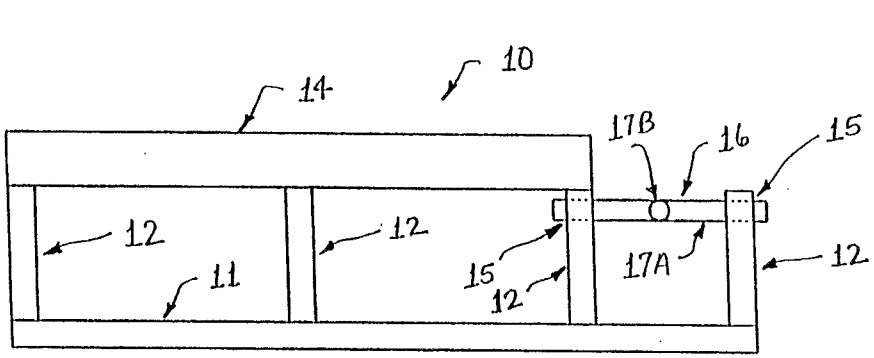
FIG. 2B is a side view of the structural frame means of the pivoting exercise apparatus.
Figure 2C:
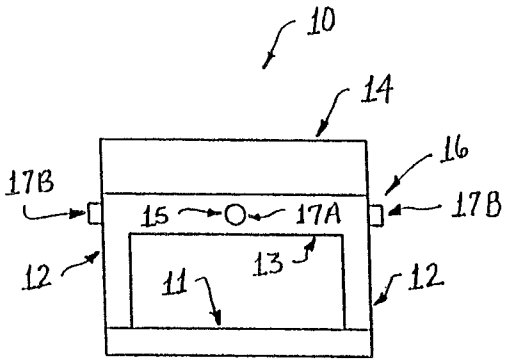
FIG. 2C is a front view of the structural frame means of the pivoting exercise apparatus.

Referring to FIGS. 2A, 2B, and 2C, the structural frame means 10 of the pivoting exercise apparatus 9 comprises basically a base 11, vertical frame supports 12, horizontal frame supports 13, back support means 14, and assembly support means 16. Base 11 is a generally rectangular structure from which vertical frame supports 12 extend upward along each side in pairs. Pairs of vertical frame supports 12 include one mounted on each side of base 11, both in the same relative plane. Horizontal frame supports 13 connect each pair of vertical frame supports 12. These horizontal frame supports 13 are used to support back support means 14 and assembly support means 16. Back support means 14 is used to support the user while in the generally reclined operative position. The two pairs of vertical frame supports 12 and the related horizontal frame supports 13, which are located towards the front of the device, are used to mount the assembly support means 16. The assembly support means 16 includes a main shaft-like member 17A with at least one shaft-like extension 17B rigidly mounted on the side, extending outward in a substantially perpendicular direction. Preferably, two shaft-like extensions 17B are used, each mounted on opposite sides of the main shaft-like member 17A, both extending outward in a substantially perpendicular direction with respect to main shaft-like member 17A. The extensions should be in general alignment with one another. It would also be possible to utilize two shaft-like members, a first shaft-like member and a second shaft-like member, the second being rigidly mounted on top or bottom of the first, in a substantially perpendicular direction. The second shaft-like member may or may not extend outward on both sides, but preferably would. Each of two horizontal frame supports 13 used to support the assembly support means 16 has assembly openings 15 through which the main shaft-like member 17A of the assembly support means 16 turnably mounts. Collars may be placed on the assembly support means to keep it in proper position on the horizontal frame support and to keep the thigh engagement means in proper position.

Figure 3E:
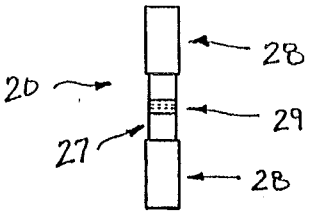
FIG. 3E is a top view of the supplemental engagement member of the thigh engagement means.
Figure 3D:
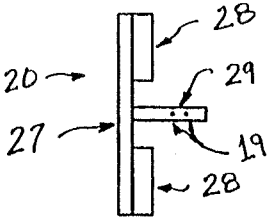
FIG. 3D is a front view of the supplemental engagement member of the thigh engagement means.
Figure 3F:
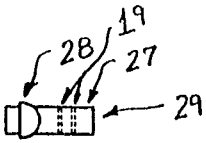
FIG. 3F is a side view of the supplemental engagement member of the thigh engagement means.
Figure 3G:
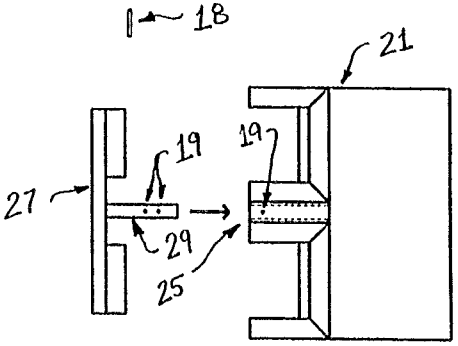
FIG. 3G demonstrates from the top view how the engagement member and the supplemental engagement member of the thigh engagement means mount together.
Figure 3C:
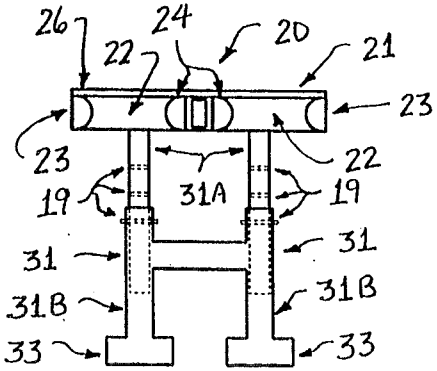
FIG. 3C is a front view of the thigh engagement means of the pivoting exercise apparatus.
Figure 3A:
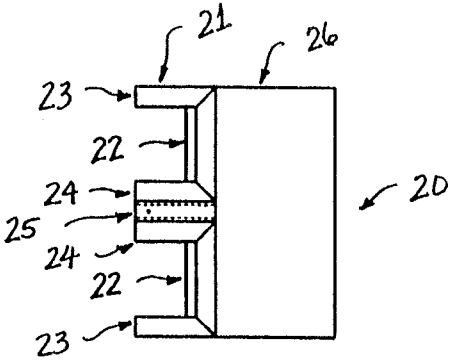
FIG. 3A is a top view of the thigh engagement means of the pivoting exercise apparatus.
Figure 3B:
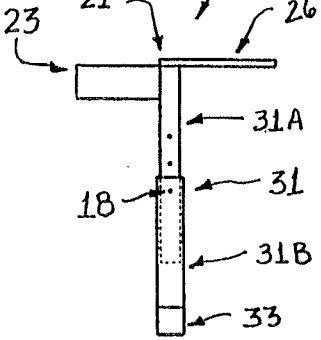
FIG. 3B is a side view of the thigh engagement means of the pivoting exercise apparatus.

As may be seen in FIGS. 3A, 3B, and 3C, the thigh engagement means 20 comprises an engagement member 21. Engagement member 21 includes back thigh supports 22, outer thigh supports 23, optional inner thigh supports 24, and support sleeve member 25. Also part of the thigh engagement means 20, as may be seen in FIGS. 3D, 3E, 3F, and 3G, is supplemental engagement member 27, which includes front thigh supports 28 and support post member 29. The back thigh support 22 and the front thigh support 28 are used by the user when engaging the thigh engagement means 20 as pivoting occurs in the forward and backward directions. The outer thigh supports 23 and optional inner thigh supports 24 are used by the user when engaging the thigh engagement means 20 as pivoting occurs in the side to side direction. The inner thigh supports 24 is considered optional because the user may use their own thighs for inner support of one another, although having inner thigh supports 24 should prove more comfortable. Preferably, the front, back, inner, and outer thigh supports all have padded coverings.

FIG. 3D demonstrates how supplemental engagement member 27 is mounted to engagement member 21. Supplemental engagement member 27 is required only when engaging the thigh engagement means in the forward to backward direction. It would not be required for engagement in the side to side direction, but should prove beneficial if used. As seen, engagement member 21 includes support sleeve member 25, mounted between the optional inner thigh supports 24, into which support post member 29 of supplemental engagement member 27 moveably fits. If inner thigh supports 24 are not used, the support sleeve member 25 may be at some other location such as on the outside of the outer thigh supports 23, and thus the location of the support post member 29 on supplemental engagement member 27 would change accordingly. Support post member 23 may have one or multiple vertical through holes 19. Support sleeve member 25 may also have one or multiple vertical through holes 19. Support post member 23 is placed within support sleeve member 25, the through holes 19 are then aligned, and a securing means 18, such as a bolt or pin, may then be placed in the through holes 19 to keep the post and sleeve members secure.

The engagement member 21 mounts to the structural frame means 10 through two vertical supports 31, which rigidly mount to engagement member 21 and extend downward in a substantially vertical direction. They then turnably mount to shaft-like extensions 17B of assembly support means 16 of structural frame means 10. One vertical support 31 could be used, but two should provide a more sturdy structure. Mounting to assembly support means 16 is through engagement sleeve members 33, which are rigidly mounted at the bottom of the vertical supports 31 and are positioned and sized to receive the shaft-like extensions 17B of assembly support means 16. A type of bearing, such as a roller or ball bearing, or low friction coating, may be used to allow easier rotation. Also, an optional cross support 32 may be used to connect the two vertical supports 31, which create an even more sturdy structure. A calf support member 36 may be rigidly mounted to the top of engagement member 21. It is a substantially planar surface which extends in the generally forward direction and is used to support the calves of the user.

The vertical supports 31 may also be divided into two components, 31A and 31B. Component 31A rigidly mounts to engagement member 21 while component 31B rigidly mounts to engagement sleeve member 33. Components 31A and 31B may be of tubular design, with component 31B being sized to loosely receive component 31A. Horizontal through holes 19 may exist in both components. Component 31A may be adjustably moved within component 31B, and the respective through holes 19 aligned. A securing means 18, such as a pin or bolt, may then be placed through the through holes 19. This feature allows the thigh engagement means to be adjusted for different user leg lengths. Similar methods may also be used to adjust the positions of the outer thigh supports for different user thigh widths, if deemed necessary.

Figure 4C:
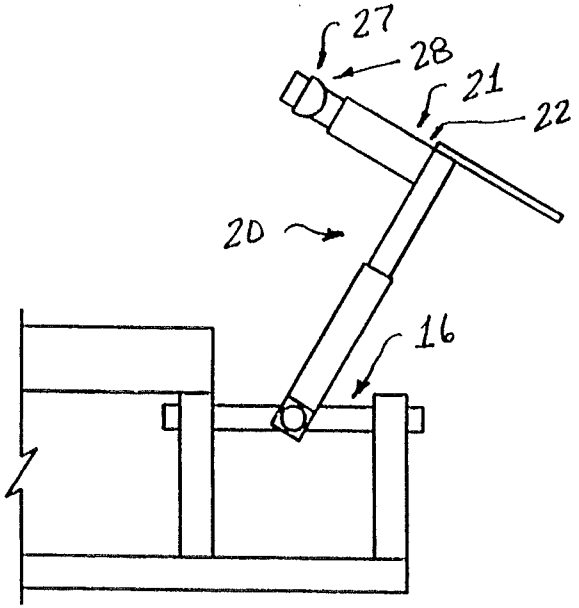
FIGS. 4A, 4B, and 4C demonstrates from a side view the different pivoting motions in the forward and backward direction by the thigh engagement means.
Figure 4B:
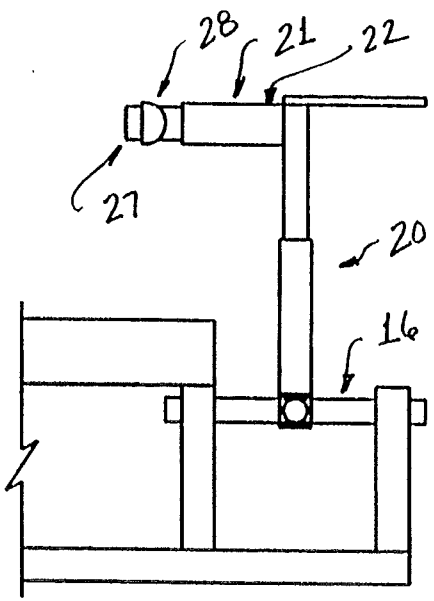
Figure 4A:
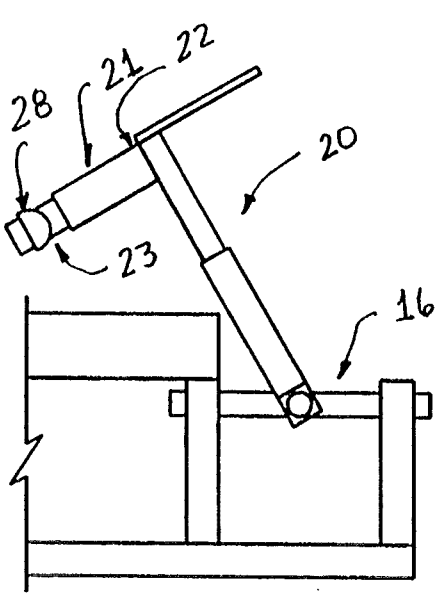

FIGS. 4A, 4B, and 4C demonstrate for a side view the pivoting motion of the thigh engagement means 20 in the forward and backward direction. The user may engage the thigh engagement means 20 and produce forward motion by pushing against the back thigh support 22 of the engagement member 21 with the back of their thighs. The thigh engagement means 20 pivots about assembly support means 16. The user may also pull back on the front thigh support 28 of the supplemental engagement member 27 with the front of their thighs. This produces backward motion in the thigh engagement means 20, which again pivots about assembly support means 16. This exercise works mainly the thighs, stomach, and buttocks areas.

Figure 5C:
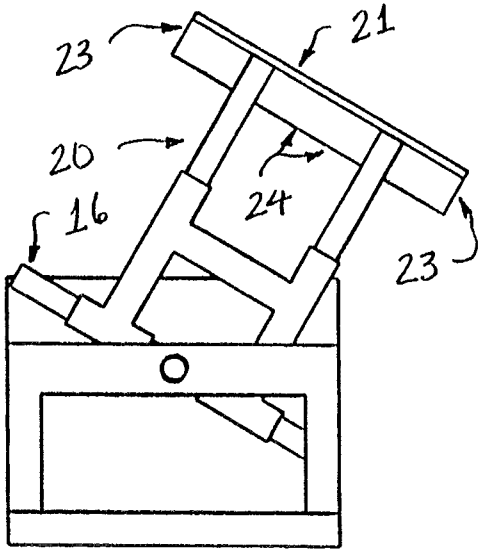
FIGS. 5A, 5B, and 5C demonstrate from the front view the different pivoting motions in the side to side direction by the thigh engagement means.
Figure 5B:
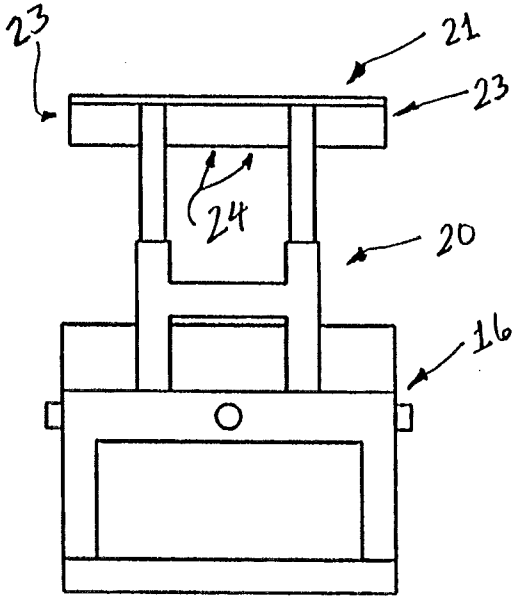
Figure 5A:
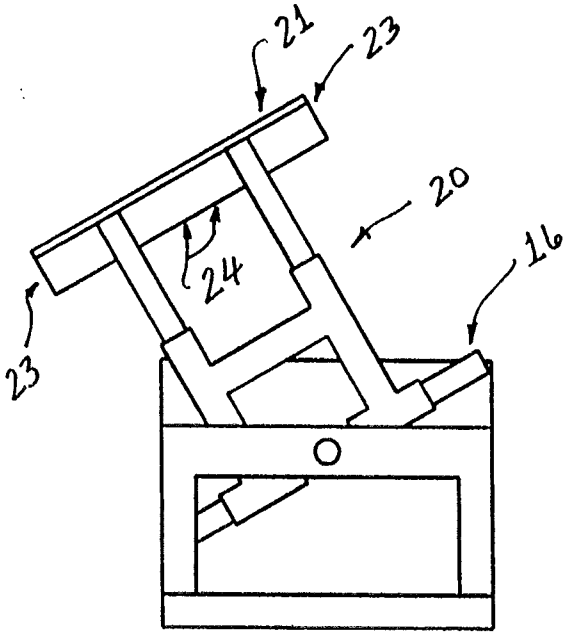

FIGS. 5A through 5C demonstrate from a back view the pivoting motion of the thigh engagement means 20 in the side to side direction. The user may push against the outer thigh support 23 of the engagement member 21 with the outer portion of one thigh, while the inner portion of the other thigh pushes against the optional inner thigh support 24. This causes pivoting motion in thigh engagement means 20 and assembly support means 16, in one side direction. When the user pushes in the opposite direction, the thigh engagement means 20 and assembly support means 16 pivot in the other side direction. The user may thus move the thigh engagement means 20 from one side to the other. This exercise works mainly the thighs, hips, and lower back areas.

As seen in FIGS. 4A–5C, the assembly support means is pivotally mounted at its front and back to the horizontal frame supports. The thigh engagement means thus pivots about assembly support means when it moves in the forward and backward direction. It pivots with the assembly support means in the side to side direction. It would also be possible to design the device so that the opposite is true. For example, the assembly support means could be pivotally mounted to the frame along the shaft-like extensions instead of the main shaft-like member. In this case, the thigh engagement means could be constructed so that it pivots with the assembly support means in the forward and backward direction, and pivots about the assembly support means in the side to side direction.

In any case, the user may engage the thigh engagement means in either the forward, backward, right side, or left side directions, or some combination. Movement of the thigh engagement means may be user induced, and a resistance means may be used in conjunction to provide a resistance force against motion in any direction. Also, it may be possible to utilize a motor means for automatically producing the movement of the thigh engagement means. The optional resistance means and optional motor means will be discussed in detail later in the specification.

Figure 6B:
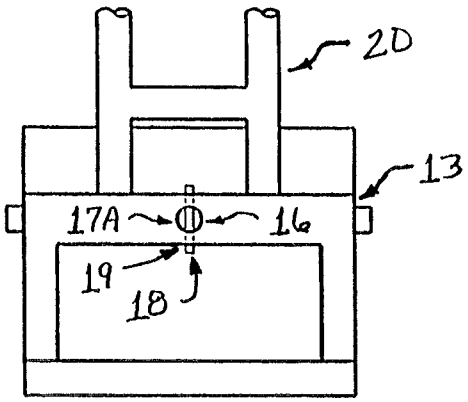
FIG. 6B demonstrates from the front view how the thigh engagement means may be adjusted to allow pivoting motion in the forward to backward direction only.
Figure 6A:
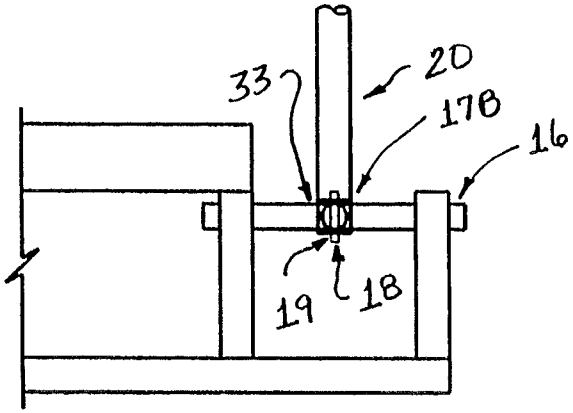
FIG. 6A demonstrates from the side view how the thigh engagement means may be adjusted to allow pivoting motion in the side to side direction only.

FIGS. 6A and 6B demonstrate from the front view how movement of the thigh engagement means 20 may be limited to either the forward and backward direction, or to the side to side direction. As seen in FIG. 6A, the shaft-like extension 17B of assembly support means 16, upon which engagement sleeve member 33 mounts, may contain a vertically extending through hole 19. A vertically extending through hole 19 may also be part of the engagement sleeve member 33. The user may align these through holes and insert a securing means 18, such as a bolt or pin. This prohibits the thigh engagement means 20 from pivoting about assembly support means 16 in the forward and backward direction. The thigh engagement means 20 would thus be able to move only in the side to side direction. In FIG. 6B, one of the horizontal frame supports 13 may have a vertically extending through hole 19. It can be aligned with a similar vertically extending through hole 19 found in main shaft-like member 17A of assembly support means 16, at the portion supported by the horizontal frame support 13. A securing means 18, such as a pin or bolt, may then be placed in the aligned holes to prohibit motion of the thigh engagement means 20 in the side to side direction. The thigh engagement means 20 would thus only be able to move in the forward or backward direction. Without the securing means, the user would be able to move the thigh engagement means in any direction. Various means, such as stops or blocks, may also be used to limit the degree of movement of the thigh engagement means.

Figure 7A:
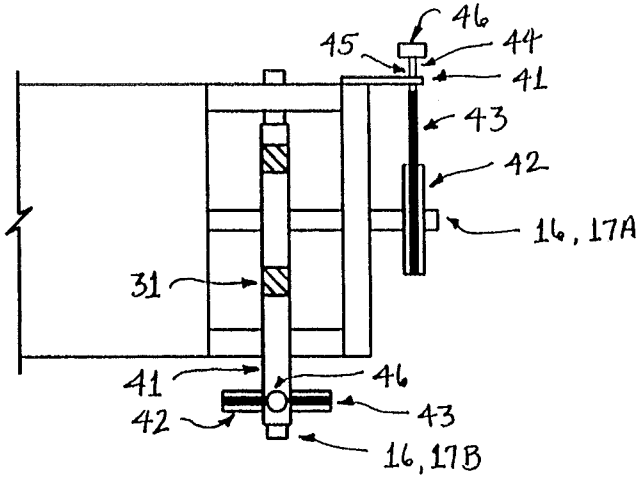
FIGS. 7A, 7B, and 7C demonstrate from the top, side, and front views, respectively, the mounting of a resistance means to the structural frame means and to the thigh engagement means to provide resistance force against the motion of the thigh engagement means.
Figure 7C:
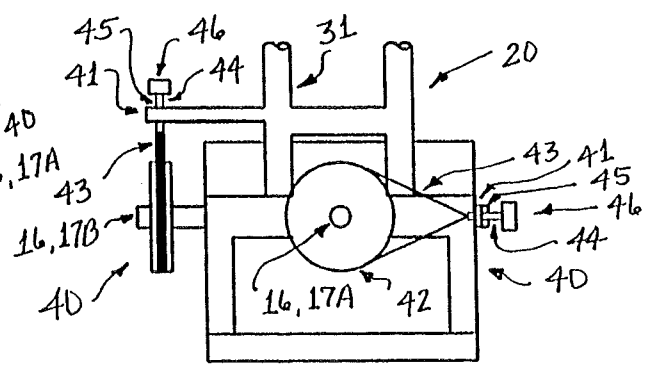
Figure 7B:
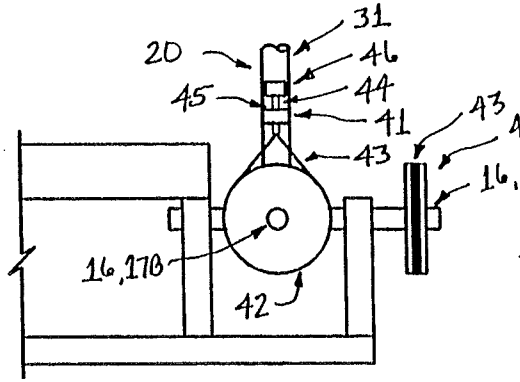

FIGS. 7A, 7B, and 7C demonstrate from the top, side, and front views, respectively, the mounting of a resistance means 40 to the assembly support means 16 and to the thigh engagement means 20, in order to provide resistance forces against the motion of the thigh engagement means 20. As seen, resistance means 40 may be a commonly seen type of resistance device. It may include resistance mount 41, circular member 42, friction belt 43, externally threaded shaft 44, internally threaded opening 45, and knob member 46. In this case, there are two resistance means 40, one for providing a resistance force against the thigh engagement means 20 as it moves in the forward and backward direction, and a second for providing resistance in the side to side direction. There are ways to have one resistance means control the resistance forces exerted in both directions, but having two allows for greater flexibility.

With regards to the resistance means 40 which provides resistance in the backward and forward direction, the resistance mount may mount to the vertical support 31 of thigh engagement means 20. Resistance mount 41 has an internally threaded opening through which an externally threaded shaft 44 turnably mounts. A knob member 46 rigidly mounts to the top of threaded shaft 44 for use by the user in turning threaded shaft 44. Circular member 42 would rigidly mount to the shaft-like extension 17B of assembly support means 16. A friction belt 43, which may be an endless belt, loosely connects to the bottom end of threaded shaft 44 and also extends around at least a portion of the periphery of circular member 42. Therefore, as thigh engagement means 20 is moved in the forward and backward direction, the friction belt 43 will move along the periphery of circular member 42. This is due to the fact that the resistance mount 41 is rigidly mounted to vertical support 31 and will move accordingly, and because circular member 42 is rigidly attached to the shaft-like extension 17B of assembly support means 16, and will therefore remain stationary.

For side to side resistance motion, the resistance means 20 includes similar components, but the mounting will be different. The resistance mount 41 will mount to a horizontal frame support 13 of structural frame means 10. Circular member 42 will rigidly mount at the forward end of the main shaft-like member 17A of assembly support means 16. Therefore, as main shaft-like member 17A turns, so will circular member 42, but the friction belt 43 will remain stationary because resistance mount 41 remains stationary.

The amount of force exerted against each circular member 42 by the corresponding friction belt 43 will correspond to the amount of resistance encountered by the user as they move thigh engagement means 20 in the forward and backward direction and/or the side to side direction. The amount of force exerted by friction belt 43 may be adjusted through knob member 46. When knob member 46 is turned in one direction, threaded shaft 44 will turn accordingly and move upward, causing friction belt 43 to tighten against circular member 42, thus increasing the resistance force. Upon turning the knob member 46 in the opposite direction, the belt will loosen and therefore the resistance force will decrease.

Figure 8A:
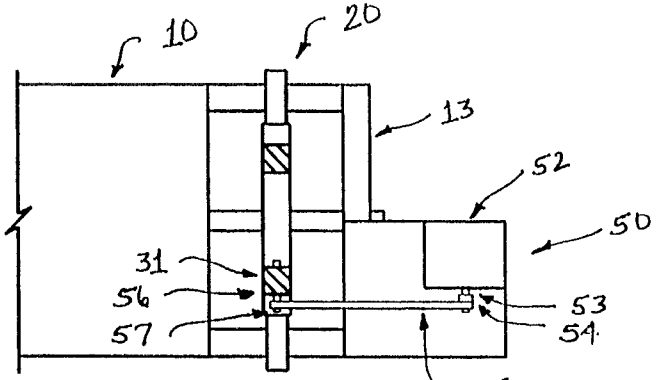
FIGS. 8A, 8B, and 8C demonstrate from the top, side, and front views, respectively, the mounting of a motor means to the structural frame means and to the thigh engagement means to provide automatic motion of the thigh engagement means in the backward and forward direction.
Figure 8B:
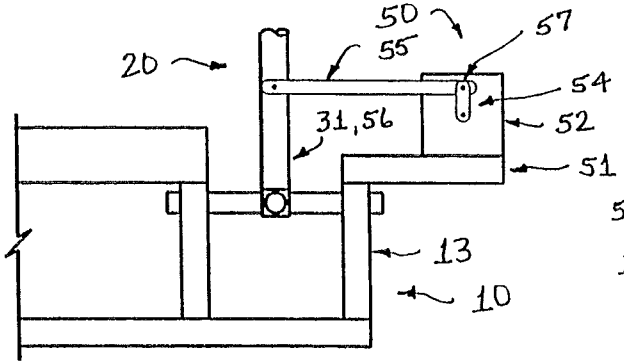
Figure 8C:
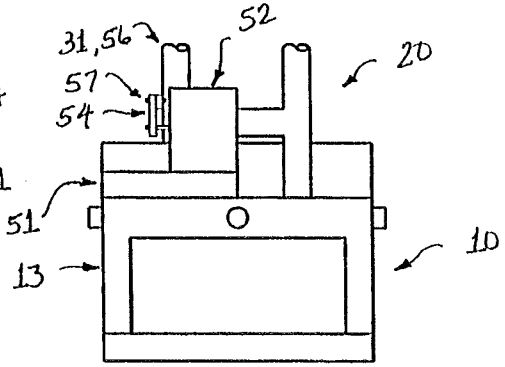

FIGS. 8A, 8B, and 8C demonstrate from the top, side, and front views, respectively, the mounting of motor means 50 to the horizontal frame support 13 of the structural frame means 10, and to the vertical support 31 of the thigh engagement means 20. This is to provide automatic motion of the thigh engagement means 20 in the backward and forward direction. Motor means 50 may include a motor mount 51, a motor 52 with motor shaft 53, and a typical rocker-crank linkage assembly comprising a crank link 54, a coupler link 55, and a rocker link 56. In this case, rocker link 56 and vertical support 31 are the same. The links may be pivotally connected together using linkage connectors 57, which may be a type of pin connection. The motor 51 may be of any conventional type, preferably electric. As seen, crank link 54 is rigidly mounted to motor shaft 53, and will rotate as motor shaft 53 rotates. Coupler link 55 pivotally connects the crank link 54 and the rocker link 56 through linkage connectors 57. Therefore, as motor shaft 53 rotates, so will crank link 54. As crank link 54 rotates, rocker link 56 will rock backward and forward, producing backward and forward turning motion in thigh engagement means 20.

Figure 9A:
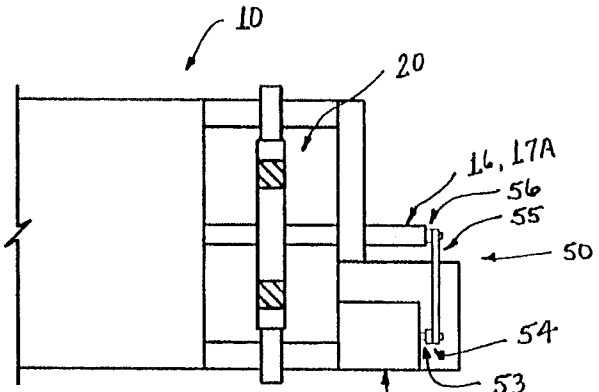
FIGS. 9A, 9B, and 9C demonstrate from the top, side, and front views, respectively, the mounting of a motor means to the structural frame means and to the assembly support means to provide automatic motion of the thigh engagement means in the side to side direction.
Figure 9B:
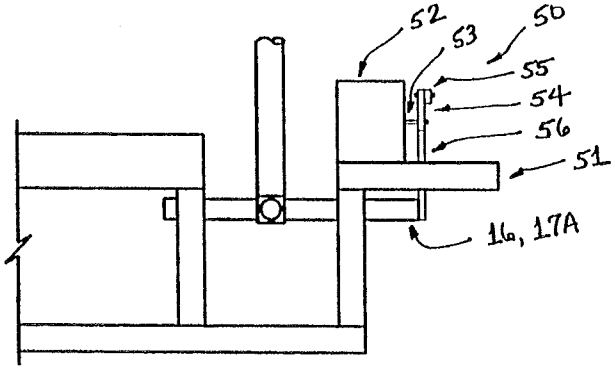
Figure 9C:
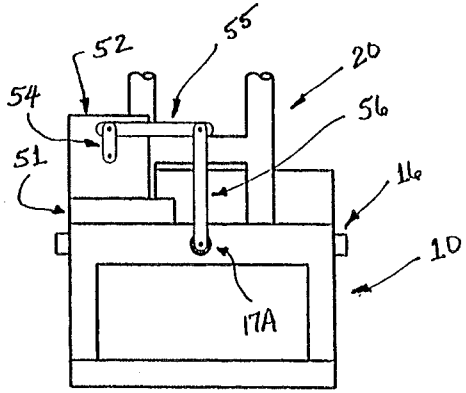

As seen in FIGS. 9A–9C, the motor and linkage assembly may be repositioned so that a rocker link 56 is now rigidly mounted to the main shaft-like member 17A of assembly support means 16. Therefore, as the motor shaft 53 rotates, so will the crank link 54. Coupler link 55 will cause rocker link 56 to rock back and forth. This causes assembly support means 16 to turn backward and forward. Since thigh engagement means 20 is mounted on assembly support means 16, it will pivot in the side to side direction.

Figure 10A:
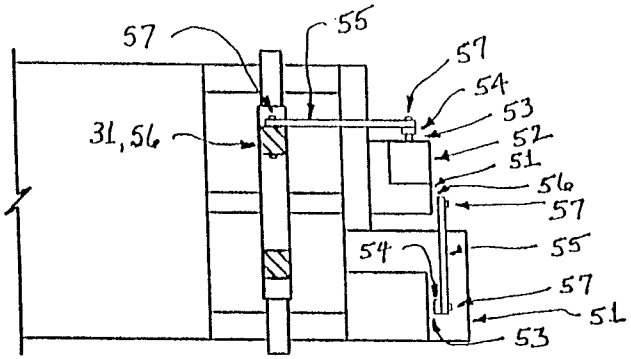
FIGS. 10A, 10B, and 10C demonstrates from the top, side, and front views, respectively, the mounting of two motors which may be used to automatically produce the forward and backward pivoting motion in the thigh engagement means simultaneously with the side to side pivoting motion.
Figure 10B:
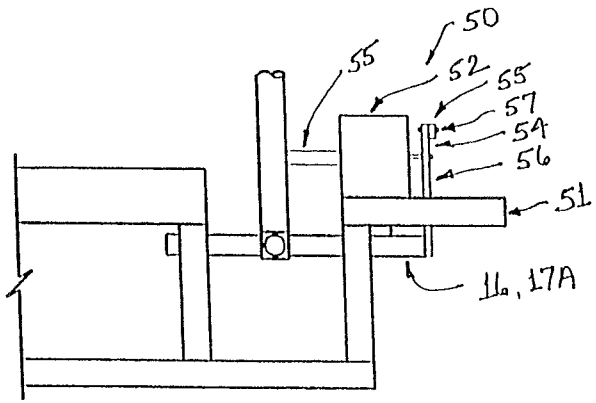
Figure 10C:
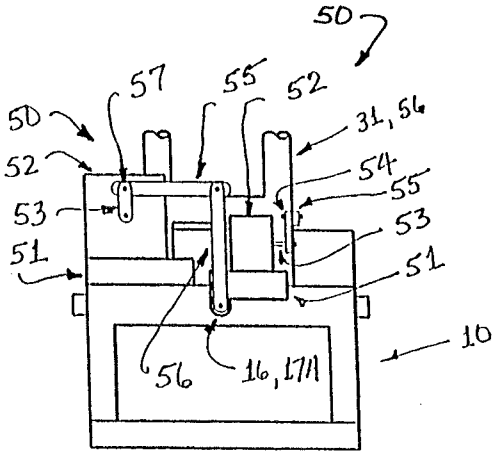

Operating two motor means simultaneously is possible, by having the two motors mounted as shown in FIGS. 10A, 10B, and 10C. One motor mount is rigidly mounted to the horizontal frame support 13, while the second is mounted to the main shaft-like member 17A of assembly support means 16, and will turn in conjunction with the means. Therefore, as one motor means pivots the thigh engagement means 20 in the backward and forward direction, the second motor is simultaneously pivoting the thigh engagement means 20 in the side to side direction.

There are many modifications, variations, alterations, and combinations which may be made to the apparatus described in this application. Different types of structural frame means, thigh engagement means, assembly support means, resistance means, and motor means may be designed to serve the same described purposes. As shown, the device can be configured in different ways to perform different functions. Pivoting motion in the thigh engagement means can be limited to the backward and forward direction, limited to the side to side direction, or not limited so that it may move in both directions simultaneously. The resistance means and the motor means can operate with the pivoting motion of the thigh engagement means in either direction, or in both directions.

While it will be apparent that the preferred embodiment of the invention herein is well-calculated to fulfill the objects above stated, it will be appreciated that the invention is susceptible to modification, variation, and change without departing from its proper scope or fair meaning of the subjoined claims.

I claim:

1. An exercise apparatus comprising:

a structural frame means comprising a rigid frame, a back support means mounted on said rigid frame, and an assembly support means turnably coupled to said rigid frame; and a thigh engagement means comprising at least one upwardly extending support member turnably coupled near its lower end to said assembly support means of said structural frame means in such a manner that the turning motion of said support member is generally perpendicular to the turning motion of said assembly support means, and an engagement member mounted near the top of said support member; whereby a user may position themself in a relatively reclined position upon said back support means of said structural frame means, engage said engagement member of said thigh engagement means with the thigh portion of their legs, and turn said thigh engagement means in the forward, backward, and side directions.

2. The exercise apparatus as claimed in claim 1, wherein said thigh engagement means further comprises a coupling means mounted near the bottom of said support member for turnably coupling said support member of said thigh engagement means to said assembly support means of said structural frame means.

3. The exercise apparatus as claimed in claim 2, said coupling means comprising a sleeve member rigidly mounted to said support member.

4. The exercise apparatus as claimed in claim 3, wherein said assembly support means comprises a main shaft-like member turnably coupled to said rigid frame of said structural frame means such that said assembly support means may be turned in the forward and backward directions, and an extension member rigidly mounted to said main shaft-like member at a substantially perpendicular position and sized to loosely fit within the hollows of said sleeve member of said thigh engagement means such that said thigh engagement means may be turned in the side directions.

5. The exercise apparatus as claimed in claim 1, wherein said engagement member of said thigh engagement means comprises front, back, and side thigh supports, and a calves support.

6. The exercise apparatus as claimed in claim 1, further comprising a resistance means operatively connected to said thigh engagement means for producing a resistance force against the forward or backward motion of said thigh engagement means.

7. The exercise apparatus as claimed in claim 6, said resistance means comprising:

a resistance mount mounted to said thigh engagement means and having an internally threaded opening;

an externally threaded shaft turnably supported by said threaded opening;

a knob member rigidly mounted to the top of said threaded shaft;

a circular member rigidly mounted to said assembly support means of said structural frame means;

a friction belt loosely connected at one end to said threaded shaft and extending around a portion of the periphery of said circular member, whereby turning said knob in one direction will tighten said friction belt around said circular member causing an increase in the resistance to the turning motion of said thigh engagement means in the forward or backward direction, and turning said knob member in the opposite direction loosens said friction belt and causes a decrease in resistance.

8. The exercise apparatus as claimed in claim 7, said circular member being a flywheel.

9. The exercise apparatus as claimed in claim 1, further comprising a resistance means operatively connected to said thigh engagement means for producing a resistance force against side motion of said thigh engagement means.

10. The exercise apparatus as claimed in claim 9, said resistance means comprising:

a resistance mount mounted to said structural frame means and having an internally threaded opening;

an externally threaded shaft turnably supported by said threaded opening;

a knob member rigidly mounted to the top of said threaded shaft;

a circular member rigidly mounted to said thigh engagement means;

a friction belt loosely connected at one end to said threaded shaft and extending around a portion of the periphery of said circular member, whereby turning said knob in one direction will tighten said friction belt around said circular member causing an increase in the resistance to the turning motion of said thigh engagement means in the side directions, and turning said knob member in the opposite direction loosens said friction belt and causes a decrease in resistance.

11. The exercise apparatus as claimed in claim 10, said circular member being a flywheel.

12. The exercise apparatus as claimed in claim 1, further comprising a motor means for producing automatic turning motion of said thigh engagement means in the forward or backward direction.

13. The exercise apparatus as claimed in claim 12, said motor means comprising:

a motor mount rigidly connected to said structural frame means and used to support a motor having a motor shaft;

a crank rigidly mounted to the motor shaft of said motor;

a coupler link loosely connecting said crank link and said thigh engagement means for translating the rotary motion of the motor shaft into forward and backward motion of said thigh engagement means.

14. The exercise apparatus as claimed in claim 12, said motor means comprising:

a motor mount rigidly connected to said assembly support means of said structural frame means and used to support a motor having a motor shaft;

a crank rigidly mounted to the motor shaft of said motor;

a coupler link loosely connecting said crank link and said thigh engagement means for translating the rotary motion of the motor shaft into a turning motion of said thigh engagement means in the forward and backward direction, simultaneous with said thigh engagement means turning in the side directions.

15. The exercise apparatus as claimed in claim 1, further comprising a motor means for producing automatic turning motion of said thigh engagement means in the side directions.

16. The exercise apparatus as claimed in claim 15, said motor means comprising:

a motor mount rigidly connected to said structural frame means and used to support a motor having a motor shaft;

a crank rigidly mounted to the motor shaft of said motor;

a rocker link rigidly mounted to the assembly support means of said structural frame means;

a coupler link loosely connecting said crank link and said rocker link for translating the rotary motion of the motor shaft into a rocking motion of said assembly support means, and thus turning motion of said thigh engagement means in the side directions.

17. The exercise apparatus as claimed in claim 3, wherein said assembly support means comprises a main shaft-like member turnably coupled to said rigid frame of said structural frame means such that said assembly support means may be turned in the side directions, and an extension member rigidly mounted to said main shaft-like member at a substantially perpendicular angle and sized to loosely fit within the hollows of said sleeve member of said thigh engagement means such that said thigh engagement means may be turned in the forward and backward directions.

* * * * *